US005356859A

United States Patent [19]

Lum et al.

[11] Patent Number: 5,356,859

[45] Date of Patent: Oct. 18, 1994

[54] RELEASE AGENT FOR THERMAL DYE TRANSFER RECEIVING ELEMENT

[75] Inventors: Kin K. Lum, Webster, N.Y.; Noel R. Vanier, Fort Collins, Colo.; Teh-Ming Kung; Linda S. Flosenzier, both of Rochester, N.Y.

[73] Assignee: Eastman Kodak Company, Rochester, N.Y.

[21] Appl. No.: 170,621

[22] Filed: Dec. 20, 1993

[51] Int. Cl.[5] ..... B41M 5/035; B41M 5/38

[52] U.S. Cl. ..... 503/227; 428/195; 428/447; 428/913; 428/914

[58] Field of Search ..... 8/471; 428/195, 447, 428/913, 914; 503/227

[56] References Cited

U.S. PATENT DOCUMENTS 4,902,669 2/1990 Matsuda et al. ..... 503/227
5,262,378 11/1993 Kung et al. ..... 503/227

FOREIGN PATENT DOCUMENTS 261970 3/1992 European Pat. Off. .
01/247196 10/1989 Japan .

*Primary Examiner*—B. Hamilton Hess
*Attorney, Agent, or Firm*—Harold E. Cole

[57] ABSTRACT

A dye-receiving element for thermal dye transfer comprising a support having on one side thereof a dye image-receiving layer, wherein the dye image-receiving layer or an overcoat layer thereon comprises a polyoxyalkylene-modified dimethylsiloxane graft copolymer with at least one alkylene oxide pendant chain containing more than 45 alkoxide units.

12 Claims, No Drawings

RELEASE AGENT FOR THERMAL DYE TRANSFER RECEIVING ELEMENT

This invention relates to dye-receiving elements used in thermal dye transfer, and more particularly to the use of certain polyoxyalkylene-modified dimethylsiloxane graft copolymers in the dye-receiving layer to prevent donor sticking.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye receiving elements used in thermal dye transfer generally include a support (transparent or reflective) bearing on one side thereof a dye image-receiving layer, and optionally additional layers. The dye image-receiving layer conventionally comprises a polymeric material chosen from a wide assortment of compositions for its compatibility and receptivity for the dyes to be transferred from the dye donor element. Dye must migrate rapidly in the layer during the dye transfer step and become immobile and stable in the viewing environment. Care must be taken to provide a receiver layer which does not stick to the hot dye-donor element. An overcoat layer can be used to improve the performance of the receiver by specifically addressing these latter problems.

In thermal dye transfer printing, only the dye in the dye layer of a dye-donor element is transferred to the dye image-receiving layer of a receiver element. Undesirable sticking can occur during this process between the dye-donor and dye-receiver elements. This defect is particularly noticeable when the entire dye layer of the dye-donor is pulled off onto the dye-receiver during separation of the two elements after printing.

In JP 01/247196, U.S. Pat. No. 4,902,669 and EPA 261,970, receiving elements with release layers containing polyoxyalkylene-modified organopolysiloxanes are disclosed. However, the polyoxyalkylene units in the organosiloxanes mentioned in the JP and U.S. patent are incorporated in the main chain of the polymer and are not "pendant" units. Also, it has not been disclosed in the above cited references that the average number of oxyalkylene subunits in the alkoxide chain of the modified polydimethylsiloxane is of significance in preventing donor sticking.

It is an object of this invention to provide a dye-receiving element which lessens the tendency of the dye-receiver to stick to the dye-donor during thermal dye transfer printing.

These and other objects are achieved in accordance with this invention which comprises a dye-receiving element for thermal dye transfer comprising a support having on one side thereof a dye image-receiving layer, wherein the dye image-receiving layer or an overcoat layer thereon comprises a polyoxyalkylene-modified dimethylsiloxane graft copolymer with at least one alkylene oxide pendant chain containing more than 45 alkoxide units. In a preferred embodiment, the polyoxyalkylene-modified dimethylsiloxane graft copolymer has the following structure:

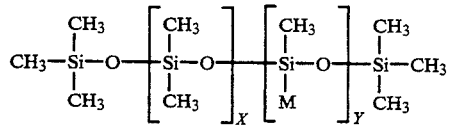

wherein:

$$M = -(C_3H_6-O)-(C_2H_4-O)_a-(C_3H_6-O)_b-R;$$

R represents hydrogen or an alkyl group having from 1 to about 4 carbon atoms;
X is 0 to 10,
Y is 0.5 to 2,
a is 0 to 100,
b is 0 to 100, and
a+b is greater than 45.

In a preferred embodiment of the invention, the polymer is present in an overcoat layer of the dye-receiver element. In another preferred embodiment, the overcoat layer comprises at least 15 wt. % of the polyoxyalkylene-modified dimethylsiloxane graft copolymer.

It has been found unexpectedly that the polyoxyalkylene-modified dimethylsiloxane graft copolymers with alkylene oxide chains of more than 45 alkoxide units in a pendant chain described above prevent donor/-receiver sticking.

Materials of the above type are surface-active copolymers. They are available under the tradename of SILWET® (Union Carbide Corp.), such as SILWET® L7210 and L7230.

The support for the dye-receiving element of the invention may be transparent or reflective, and may be a polymeric, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference.

The dye image-receiving layer may be present in any amount which is effective for its intended purpose. In general, good results have been obtained at a receiver layer concentration of from about 0.5 to about 10 g/m$^2$.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises image-wise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

EXAMPLE 1

Dye-receiving elements were prepared by coating onto a microvoided poly(propylene terephthalate) support (obtained from Oji Paper Co.) the following layers in the order recited:

(1) subbing layer of Dow Z-6020 surfactant (N-(2-aminoethyl)-3-aminopropyl trimethoxysilane from Dow Corning Co.) (0.11 g/m$^2$) coated from ethanol;

(2) dye-receiving layer of Makroion ® 5700 bisphenol A polycarbonate (Bayer AG) (1.6 g/m$^2$), a random copolymer of 4,4'-isopropylidene-bisphenol-co-2,2'-oxydiethanol poylcarbonate (50:50) (1.6 g/m$^2$), dibutyl phthalate (0.32 g/m$^2$), diphenyl phthalate (0.32 g/m$^2$) and Fluorad FC-431 ® fluorosurfactant (3M Corporation) (0.01 g/m$^2$) coated from methylene chloride and trichloromethane (80:20); and (3) overcoat layer of a linear condensation copolycarbonate of bisphenol-A (50 mole %), diethylene glycol (49 mole %), and 2,500 MW polydimethylsiloxane block units (1 mole %) (0.22 g/m$^2$), Fluorad FC-431 ® (0.02 g/m$^2$), Dow Corning 510 Silicone Fluid (0.01 g/m$^2$), and the polysiloxane lubricant as listed in Table 1 (0.05 g/m$^2$) below coated from methylene chloride and trichloromethane (80:20).

The following table shows the various polysiloxane lubricants used in the elements of the example.

TABLE 1

| Element | Polysiloxane Employed |
|---|---|
| 1 | None (Control) |
| 2 | SILWET ® L720 (Control) |
| 3 | SILWET ® L7200 (Control) |
| 4 | SILWET ® L7500 (Control) |
| 5 | PS043* (Control) |
| 6 | PS513** (Control) |
| 7 | PS812*** (Control) |
| 8 | SILWET ® L7210 |
| 9 | SILWET ® L7230 |

*a polydimethylsiloxane, (Petrarch Systems, Inc.)
**an aminopropyl-dimethyl-terminated polydimethylsiloxane, (Petrarch Systems, Inc.)
***a polydimethylsiloxane with aminopropyl side chains, (Petrarch Systems, Inc.)

The significant parameters of the Silwet ® lubricants are shown in Table 2.

TABLE 2

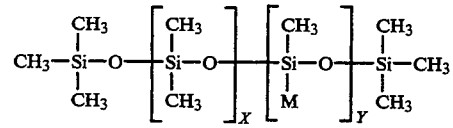

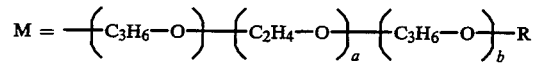

| SILWET ® | X | Y | a | b | R | average number of alkoxide units in pendant chain |
|---|---|---|---|---|---|---|
| L7210 | 2.4 | 0.95 | 11.5 | 35.3 | H | 49.3 |
| L7230 | 5.6 | 0.75 | 18.8 | 24.0 | H | 57.0 |
| L7500 Control | 5.8 | 1.75 | 0 | 4.0 | $C_4H_9$ | 2.3 |
| L7200 Control | 6.5 | 1.0 | 32.6 | 7.67 | H | 40.3 |

A black dye-donor element was prepared by coating the following layers in order on a 6 μm poly(ethylene terephthalate) support:

(1) subbing layer of Tyzor TBT (titanium tetra-n-butoxide) (DuPont Co.) (0.13 g/m$^2$) from a n-propyl acetate and 1-butanol solvent mixture; and (2) dye layer containing a mixture of Yellow Dye 1 (0.15 g/m$^2$), Magenta Dye 1 (0.22 g/m$^2$), Magenta Dye 2 (0.04 g/m$^2$) and Cyan Dye 1 (0.50 g/m$^2$), illustrated below, S-363N1 (a micronized blend of polyethylene, polypropylene and oxidized polyethylene particles) (Shamrock Technologies, Inc.)

(0.02 g/m$^2$) in a binder mixture of cellulose acetate propionate (2.5% acetyl, 45% propionyl), CAP482-20, 20 sec. viscosity, (0.05 g/m$^2$) and cellulose acetate propionate (2.5% acetyl, 45% propionyl), CAP 482-0.5, 0.5 sec. viscosity (0.44 g/m$^2$) from a toluene, methanol, and cyclopentanone solvent mixture (66.5:28.5:5).

On the reverse side of the support was coated:

(1) subbing layer of Tyzor ® TBT (0.13 g/m$^2$) from a n-propyl acetate and 1-butanol solvent mixture; and (2) slipping layer of CAP482-20, (0.08 g/m$^2$), CAP 482-0.5, (0.45 g/m$^2$), PS-513 (an aminopropyl dimethyl terminated polydimethyl siloxane) (Petrarch Systems, Inc.) (0.01 g/m$^2$), p-toluenesulfonic acid (5% in methanol) (0.003 g/m$^2$), and Montan wax slurry (0.03 g/m$^2$) coated from a toluene, methanol and cyclopentanone solvent mixture (66.5:28.5:5).

The following dyes were used in the experiments:

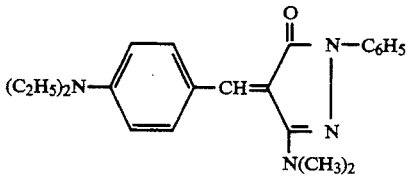

Yellow Dye 1

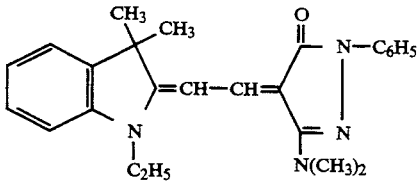

Yellow Dye 2

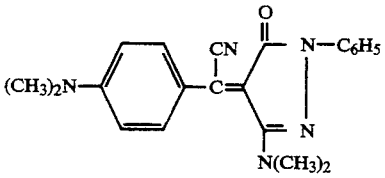

Magenta Dye 1

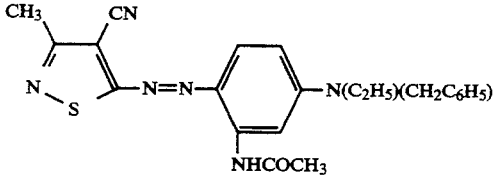

Magenta Dye 2

-continued

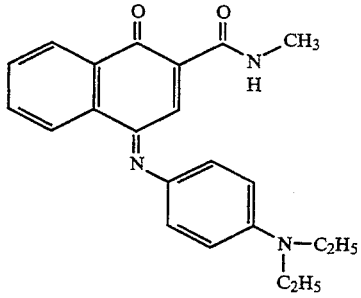

Cyan Dye 1

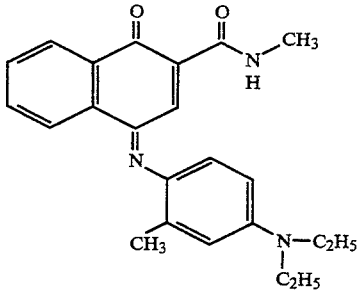

Cyan Dye 2

The dye side of the dye-donor element approximately 10 cm×13 cm in area was placed in contact with the polymeric receiving layer side of the dye-receiver element of the same area. The assemblage was clamped to a stepper-motor driven 60 mm diameter rubber roller, and a TDK Thermal Head (No.L-231) (thermostated at 26° C.) was pressed with a force of 24.5 Newtons against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 29 microseconds/pulse at 128 microsecond intervals during the 33 msec/dot printing time. A Latin square density image was generated with regions of varying density by setting the number of pulses/dot for a particular density at a set value between 0 to 255. The voltage supplied to the print head was approximately 23.5 volts, resulting in an instantaneous peak power of 1.3 watts/dot and a maximum total energy of 9.6 mjoules/dot.

The dye transfer element was separated from the receiving element immediately after passing the thermal head in a "peeling while printing" mode. The receiver element was then backed up and the position reinitialized under the head and printed again with a fresh, unused piece of donor such that the images were in register with each other. This was repeated until sticking failure between the dye transfer element and the receiver element occurred, referred to as printing to failure and the results were recorded as the number of printings which could be made on a receiver before dye transfer layer failure occurred (prints to fail). The following results were obtained:

TABLE 3

| ELEMENT | PRINTS TO FAIL |
|---|---|
| 1 (Control) | 4 |
| 2 (Control) | 3 |

TABLE 3-continued

| ELEMENT | PRINTS TO FAIL |
|---|---|
| 3 (Control) | 4 |
| 4 (Control) | 3 |
| 5 (Control) | 3 |
| 6 (Control) | 3 |
| 7 (Control) | 3 |
| 8 | 5 |
| 9 | 7 |

The above results indicate that the addition of a polyoxyalkylene dimethylsiloxane copolymer with pendant alkylene oxide chains of more than 45 units improved the sticking performance, as compared to other modified polysiloxane lubricants and polyoxyalkylene dimethylsiloxane copolymers with shorter side chains which do not improve sticking performance.

EXAMPLE 2

The dye-receiving element of Example 1 was employed in this Example. The dye-donor element consisted of different color patches as follows:

Yellow Patch:
0.26 g/m$^2$ Yellow Dye 2
0.27 g/m$^2$ CAP482-20
0.07 g/m$^2$ CAP482-0.5
0.01 g/m$^2$ S363 N-1
0.002 g/m$^2$ Fluorad ® FC-430
solvent 66.5% toluene/28.5% methanol/5% cyclopentanone Magenta Patch:
0.15 g/m$^2$ Magenta Dye 1
0.14 g/m$^2$ Magenta Dye 2
0.24 g/m$^2$ CAP482-20
0.08 g/m$^2$ CAP482.5
0.01 g/m$^2$ S363 N-1
0.002 g/m$^2$ Fluorad ® FC-430
solvent 66.5% toluene/28.5% methanol/5% cyclopentanone Cyan Patch:
0.38 g/m$^2$ Cyan Dye 1
0.11 g/m$^2$ Cyan Dye 2
0.34 g/m$^2$ CAP482-20
0.01 g/m$^2$ S363 N-1
0.002 g/m$^2$ Fluorad ® FC-430
solvent 66.5% toluene/28.5% methanol/5% cyclopentanone On the opposite side of the dye-donor element was coated the following slipping layer: 0.54 g/m$^2$ KS-1 poly(vinyl acetal) (Sekisui Chemical Co., Ltd.), 0.0003 g/m$^2$ p-toluenesulfonic acid, 0.01 g/m$^2$ PS-513 (an aminopropyl dimethyl terminated polydimethyl siloxane) (Petrarch Systems, Inc.), and 0.008 g/m$^2$ BYK S732 [a copolymer of poly(propylene oxide) and poly(methyloctyl siloxane) 98% in Stoddard solvent, available from BYK Chemie].

The dye side of a dye-donor element strip approximately 12 cm wide was placed in contact with the dye image-receiving element approximately 12 cm×15 cm. One edge of the receiver was placed between a pinch roller and a stepper-motor. This setup was used to pull the receiver over a 17.91 mm diameter rubber roller, and a TDK Thermal Head LV-540B (thermosrated at 30.6° C.) was pressed with a force of 24.5 Newtons against the dye-transfer element side of the assemblage pushing it against the rubber roller. The dye transfer element was attached at one end onto a stepper-motor driven platen which acted to pull the donor through the nip made by the rubber roller and the thermal head. The opposite end of the donor was wound off from a supply spool. The dye transfer element and the receiving element were run in opposite directions and the receiver element to transfer element speed ratio was 3.3 to 1.0. The TDK LC-540B thermal print head used had 2560 independently addressable heaters with a resolution of 11.81 dots/mm and an active printing width of 217 mm of average heater resistance 3449 ohms. For actual printing only 86.7 mm of the total width was utilized.

During printing, the imaging electronics were activated causing the receiver to be drawn between the printing head and roller at 4.7 mm/sec and the dye transfer element to be drawn in the opposite direction at 1.4 mm/sec. Coincidentally, the resistive elements in the thermal print head were pulsed for 126.8 microseconds every 130 microseconds. Printing maximum density required 127 pulses "on" time per printed line of 17.94 milliseconds. The voltage supplied was 12.5 volts resulting in an instantaneous peak power of approximately 0.044 Watts/dot. The maximum total energy for this printing scheme was 0.71 mjoules/dot. The image was printed with a 1:1 aspect ratio, This printing scheme was repeated in succession for each of the three color dye transfer elements or until sticking failure occurred.

The printing pass and the maximum printing energy which could be reached before sticking failure occurred are recorded in Table 4 for each of the 9 receiver elements.

TABLE 4

| | Maximum energy before sticking occurred | | |
|---|---|---|---|
| ELEMENT | 1st PASS | 2nd PASS | 3rd PASS |
| 1 (Control) | 0.5 mjoules/dot | | |
| 2 (Control) | 0.57 mjoules/dot | | |
| 3 (Control) | 0.64 mjoules/dot | | |
| 4 (Control) | 0.57 mjoules/dot | | |
| 5 (Control) | 0.57 mjoules/dot | | |
| 6 (Control) | 0.64 mjoules/dot | | |
| 7 (Control) | 0.5 mjoules/dot | | |
| 8 | no sticking | 0.5 mjoules/dot | |
| 9 | no sticking | no sticking | 0.57 mjoules/dot |

The above results indicate that the addition of a polyoxyalkylene dimethylsiloxane copolymer with alkylene oxide chains of more than 45 units improves the printing performance in a relative speed printing mode.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a dye image-receiving layer, wherein said dye image-receiving layer or an overcoat layer thereon comprises a polyoxyalkylene-modified dimethylsiloxane graft copolymer with at least one alkylene oxide pendant chain containing more than 45 alkoxide units.

2. The element of claim 1 wherein said polyoxyalkylene dimethylsiloxane copolymer has the following structure:

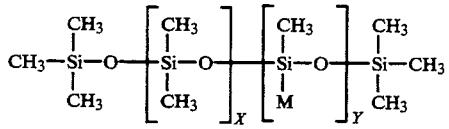

wherein:

$$M = \text{-}(C_3H_6\text{-}O)\text{-}(C_2H_4\text{-}O)_a\text{-}(C_3H_6\text{-}O)_b\text{-}R;$$

R represents hydrogen or an alkyl group having from 1 to about 4 carbon atoms;
X is 0 to 10,
Y is 0.5 to 2,
a is 0 to 100,
b is 0 to 100, and
a+b is greater than 45.

3. The element of claim 2 wherein said polymer is present in an overcoat layer of said dye-receiving element.

4. The element of claim 3 wherein said overcoat layer comprises at least 15 wt. % of the polyoxyalkylene dimethylsiloxane copolymer.

5. A process of forming a dye transfer image comprising imagewise-heating a dye-donor element and transferring a dye image to a dye-receiving element comprising a support having thereon a dye image-receiving layer to form said dye transfer image, wherein said dye image-receiving layer or an overcoat layer thereon comprises a polyoxyalkylene-modified dimethylsiloxane graft copolymer with at least one alkylene oxide pendant chain containing more than 45 alkoxide units.

6. The process of claim 5 wherein said polyoxyalkylene dimethylsiloxane copolymer has the following structure:

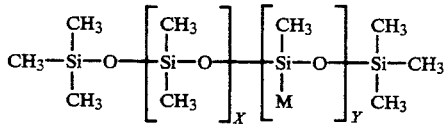

wherein:

$$M = \text{-}(C_3H_6\text{-}O)\text{-}(C_2H_4\text{-}O)_a\text{-}(C_3H_6\text{-}O)_b\text{-}R;$$

R represents hydrogen or an alkyl group having from 1 to about 4 carbon atoms;
X is 0 to 10,
Y is 0.5 to 2,
a is 0 to 100,
b is 0 to 100, and
a+b is greater than 45.

7. The process of claim 6 wherein said polymer is present in an overcoat layer of said dye-receiving element.

8. The process of claim 7 wherein said overcoat layer comprises at least 15 wt. % of the polyoxyalkylene dimethylsiloxane copolymer.

9. A thermal dye transfer assemblage comprising: (a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer; wherein said dye image-receiving layer or an overcoat layer thereon comprises a polyoxyalkylene-modified dimethylsiloxane graft copolymer with at least one alkylene oxide pendant chain containing more than 45 alkoxide units.

10. The assemblage of claim 9 wherein said polyoxyalkylene dimethylsiloxane copolymer has the following structure:

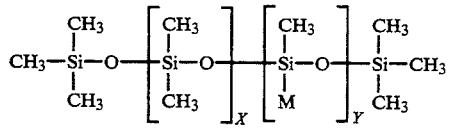

wherein:

$$M = \text{-}(C_3H_6\text{-}O)\text{-}(C_2H_4\text{-}O)_a\text{-}(C_3H_6\text{-}O)_b\text{-}R;$$

R represents hydrogen or an alkyl group having from 1 to about 4 carbon atoms;
X is 0 to 10,
Y is 0.5 to 2,
a is 0 to 100,
b is 0 to 100, and
a+b is greater than 45.

11. The assemblage of claim 10 wherein said polymer is present in an overcoat layer of said dye-receiving element.

12. The assemblage of claim 11 wherein said overcoat layer comprises at least 15 wt. % of the polyoxyalkylene dimethylsiloxane copolymer.

* * * * *